US010487599B2

(12) United States Patent
Johnson

(10) Patent No.: US 10,487,599 B2
(45) Date of Patent: Nov. 26, 2019

(54) BELL NIPPLE

(71) Applicant: SCHLUMBERGER TECHNOLOGY CORPORATION, Sugar Land, TX (US)

(72) Inventor: Ashley Bernard Johnson, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 121 days.

(21) Appl. No.: 15/555,493

(22) PCT Filed: Feb. 19, 2016

(86) PCT No.: PCT/US2016/018555
§ 371 (c)(1),
(2) Date: Sep. 1, 2017

(87) PCT Pub. No.: WO2016/140807
PCT Pub. Date: Sep. 9, 2016

(65) Prior Publication Data

US 2018/0045001 A1 Feb. 15, 2018

(30) Foreign Application Priority Data

Mar. 2, 2015 (GB) ..... 1503494.5

(51) Int. Cl.
*E21B 19/24* (2006.01)
*E21B 21/08* (2006.01)
(Continued)

(52) U.S. Cl.
CPC ..... *E21B 19/24* (2013.01); *E21B 17/07* (2013.01); *E21B 19/002* (2013.01); *E21B 21/001* (2013.01); *E21B 21/08* (2013.01)

(58) Field of Classification Search
CPC ..... E21B 19/002; E21B 19/24; E21B 17/01; E21B 17/07; E21B 21/001; E21B 21/08; E21B 23/02; E21B 23/03; E21B 33/035; E21B 33/037; E21B 33/043; E21B 33/076; E21B 41/0007
See application file for complete search history.

(56) References Cited

U.S. PATENT DOCUMENTS 3,354,950 A * 11/1967 Hyde ..... E21B 17/07 166/336
RE29,562 E * 3/1978 Wray ..... E21B 49/001 166/162

(Continued)

*Primary Examiner* — David Carroll

(57) ABSTRACT

A bell nipple for use in an offshore wellbore operation comprising an upper tubular member and a lower tubular member connected telescopically via a slip joint, one or more pistons at the level of the radial plane which is defined by the lowest point of the side outlet and each substantially not axially movable relative to the lower tubular member, wherein the total cross sectional area of the one or more pistons is substantially the same as the cross sectional area of the slip joint less the cross sectional area of the drillpipe. The one or more pistons in the bell nipple provides passive heave compensation in the system, so that the flow rate of drilling fluid measured along the flowline is free from perturbation due to heave during offshore operations.

19 Claims, 2 Drawing Sheets

(51) Int. Cl.

| | |
|---|---|
| ***E21B 19/00*** | (2006.01) |
| ***E21B 21/00*** | (2006.01) |
| ***E21B 17/07*** | (2006.01) |

(56) References Cited

U.S. PATENT DOCUMENTS

| | | | | |
|---|---|---|---|---|
| 4,282,939 | A | | 8/1981 | Maus et al. |
| 4,367,981 | A | * | 1/1983 | Shapiro ..... E21B 7/128 166/355 |
| 4,411,434 | A | | 10/1983 | Lewis |
| 4,626,135 | A | | 12/1986 | Roche |
| 5,168,932 | A | | 12/1992 | Worrall et al. |
| 2013/0014991 | A1 | | 1/2013 | Leuchtenberg |
| 2014/0166273 | A1 | | 6/2014 | Bailey et al. |
| 2015/0013994 | A1 | | 1/2015 | Bailey et al. |

* cited by examiner

BELL NIPPLE

BACKGROUND

Embodiments of the present disclosure relate to a bell nipple for use in an offshore wellbore operation and pertain more particularly to a bell nipple comprising a piston for the purpose of passive heave compensation.

A hole is often drilled in the ground for the extraction of a natural resource such as ground water, brine, natural gas, or petroleum. In offshore drilling, a wellbore is drilled through the seabed in order to explore for and subsequently extract petroleum, which lies in rock formations beneath the seabed.

Offshore drilling is carried out from a floating rig, such as a drill ship, a semi-submersible platform, a floating drilling platform or a production platform. Similar to onshore drilling, a drill bit is suspended in the wellbore being drilled on a drillstring and rotated against the bottom of the wellbore in order to remove rock formations beneath the seabed and extend the wellbore.

During drilling of a subsea wellbore from a floating rig, a marine riser is used to return the drilling fluid, which is also called drilling mud, and rock cuttings from the wellbore to the surface. The riser is a pipe that extends from the drilling platform down to the seafloor. Drilling mud and cuttings from the borehole are returned to the surface through the riser annulus, which is an annulus formed between the drillpipe within the riser and the riser. The top of the riser is attached to the floating rig, while its bottom is secured to the wellhead at the seafloor. A blowout preventer (BOP) placed at the seafloor between the wellhead and the riser provides protection against over-pressured formations and sudden release of gas.

The top section of a riser is provided by a bell nipple. A bell nipple is an enlarged pipe at the top of a riser that serves as a funnel to guide drilling tools into the top of a well. The bell nipple is usually fitted with a side outlet to permit drilling fluids that have been circulated through the wellbore to flow to the mud treating equipment at the surface through another inclined pipe called a flowline.

The flowline is a metal pipe that connects the bell nipple under the rotary table to the possum belly at the mud tanks. The flowline is simply an inclined, gravity-flow conduit to direct mud coming out the top of the wellbore to the mud surface-treating equipment. When drilling certain highly reactive clays, the flowline may become plugged and require considerable effort by the rig crew to keep it open and flowing. In addition, the flowline is usually fitted with a crude paddle-type flow-measuring device commonly called a "flow show" that may give the driller the first indication that the well is flowing and/or a rate of flow.

The flowline may also be fitted with a flowmeter, such as a coriolis flowmeter or the like. A coriolis flow meter is a mass flow meter, also known as an inertial flow meter. The coriolis flow meter is a device that measures how much liquid is flowing through a tube. It does not measure the volume of the liquid passing through the tube, but measures the amount of mass flowing through the device.

The measurement of the flow rate of drilling fluids is very important for safe and effective drilling and logging operations. Accurately measuring the balance of the drilling fluids as a system, i.e. barrels-in versus barrels-out, provides important information to the driller and the mud logger, for example: early warning kick detection (a kick occurs when formation fluids flow into the wellbore and up the drill string due to imbalance of hydrostatic pressures); tracking ballooning and allowing the driller to differentiate between ballooning and kick; and accurate mud flow rate which is used by mud loggers to compute transport velocity and lag time, which is the time it takes for the mud to circulate from the drill bit to the surface.

Floating oil rigs such as drill ships and semi-submersible platforms are subjected to wave motion. During passage of a wave, the floating rig undergoes a vertical movement. Because the waves are not generally consistent in form or frequency, the rig undergoes a random vertical motion, while procedures such as drilling are carried out on the floating rig.

When drilling of a subsea wellbore is carried out using a floating rig, it is known to provide a riser with a slip joint, which allows the riser to lengthen and shorten as the rig heaves as the sea level rises and falls with the tides and the waves. Such a slip joint is, for example, described in U.S. Pat. Nos. 4,626,135 and 4,411,434, and comprises a first tube section, which is connected to the rig floor, and a second tube section that is connected to the wellhead at the seafloor, where the first and the second tube sections are connected telescopically so that the two tube sections can move vertically with respect to each other, thus permitting vessel heave while maintaining connection of the riser pipe to the seafloor. As the vessel heaves, the slip joint telescopes in or out by the same amount so that the riser below the slip joint is relatively unaffected by vessel motion.

In some configurations, the second tube section comprises an outer tube section that is disposed around the first tube section, which forms an inner tube section. In such configurations, seals are normally provided between the outer and inner tube sections, and these substantially prevent leakage of fluid from the riser whilst allowing the inner tube section to slide relative to the outer tube section.

In the North Sea, a riser is likely to encounter heave of between about 5-10 meters, so the slip joint needs to allow for vertical height movement of at least about 5 meters. Heave of more than 10 meters may be encountered, but it is currently considered unsafe to perform drilling operations under these conditions using existing technologies.

Heave motion at the upper end of the riser leads to a perturbation of flowrate of the drilling fluid out of the top of the riser annulus through the side outlet into the flowline. This means that any attempt to measure the flow rate out of the riser annulus, e.g. by a coriolis flow meter, is flawed and a complicated system of measuring the heave of the floating rig must be used to obtain any meaningful flow rate measurements out of the riser annulus.

SUMMARY OF THE DISCLOSURE

The present disclosure seeks to overcome the drawbacks of the known bell nipples and marine risers.

In a first aspect, embodiments of the present disclosure address these problems by providing a bell nipple for use with a drillpipe in an offshore wellbore operation comprising: an upper tubular member and a lower tubular member, wherein the upper tubular member and the lower tubular member are connected telescopically via a slip joint and are axially movable relative to each other between a contracted position and an expanded position; a side outlet in the upper tubular member for connection with a side pipe, wherein the lowest point of the side outlet defines a radial plane of the upper tubular member; and one or more pistons which are fixed so that they are each substantially not axially movable relative to the lower tubular member, wherein the bottom surface of each piston is not above the radial plane at the contracted position, and the top surface of each piston is not below the radial plane at the expanded position, wherein the total cross sectional area of the one or more pistons at any radial plane in between the radial plane at the contracted position and the radial plane at the expanded position, is substantially the same as the cross sectional area of the slip joint less the cross sectional area of the drillpipe at the same radial plane.

The upper tubular member may comprise a section that is disposed around a section of the lower tubular member, which can telescope in and out of the section of the upper tubular member. Alternatively, the lower tubular member may comprises a section that is disposed around a section of the upper tubular member, which telescope in and out of the section of the lower tubular member. Thus, either tubular member may act as the inner tubular member of the telescope, while the other tubular member can act as the outer tubular member.

The side pipe, which is connected to the side outlet, may be a flowline, through which the drilling fluid may flow back to the surface mud treating equipment.

The radial plane defined by the lowest point of the side outlet is a cross sectional plane of the upper tubular member which comprises and passes through the lowest point of the side outlet. The cross sectional plane is perpendicular to the axis of the upper tubular member.

If the bell nipple is perfectly vertical in operation, the radial plane would coincide with the discharge line or the mud level in the system which is always horizontal due to gravity. If the bell nipple tilts in operation, the radial plane which is perpendicular to the axis of the bell nipple would no longer coincide with the discharge line or the mud level in the system.

As discussed above, when a floating drilling vessel heaves, the displacement of the slip joint at the top of the marine riser perturbs the rate of flow out of the top of the annulus. The problem of perturbation in the rate of flow of drilling fluid from the top of the annulus is in turn an issue in measuring the rate of flow and monitoring of the downhole environment.

To counter these effects, the bell nipple uses a bias piston attached to the lower section of the riser below the slip joint. The piston is secured to the lower riser section keeping it stationary with respect to the lower riser section. The cross sectional area of the piston is the same as the cross sectional area of the slip joint less the drillpipe. As the slip joint opens, the rig and the upper section of the slip joint goes up, and the swept volume increase of the slip joint is equal to the swept volume of the piston displaced into the drilling fluid, so the actual volume of the mud up to the return line weir remains constant. There will be some second order wetting effects, but the first order is compensated and hence the flow rate of the drilling fluid in the flowline would better represent the flow rate in the wellbore below the slip joint. Any perturbations in the flow are no longer due to the heave of the drilling vessel, but instead can indicate problems and conditions in the downhole environment.

The effect produced by the piston's movement can be achieved by one piston, or a plurality of pistons. When a plurality of pistons are provided, the pistons may be concentrated in one area of the riser annulus, or spread throughout the riser annulus. If they are spread out, they may be distributed evenly or unevenly.

The one or more pistons are each substantially not axially movable relative to the lower tubular member. In some embodiments, the one or more pistons may also be each substantially not radially movable relative to the lower tubular member.

As the bell nipple expands and contracts, the upper tubular member moves up and down with respect to the lower tubular member. The upper tubular member moves with it the lowest point of the side outlet and thus the radial plane defined by this lowest point.

The one or more pistons are at the level of the radial plane, which is defined by the lowest point of the side outlet. Because the one or more pistons stay stationary with respect to axial movements of the lower tubular member, i.e. there is no relative axial movement between the pistons and the lower tubular member, the radial plane as defined by the lowest point of the side outlet runs along the axial length of the one or more pistons, as the bell nipple contracts and expands. As the bell nipple expands, the radial plane moves up the axial length of the pistons gradually. Similarly, as the bell nipple contracts, the radial plane moves down the axial length of the pistons gradually. As the bell nipple expands and contracts, each total axial length of the bell nipple corresponds to a respective radial plane which is at a different axial location with respect to the lower tubular member, and each radial plane corresponds to a respective axial location along the length of the pistons. Thus, each location along the axial length of the pistons can be defined by a respective radial plane when the bell nipple is at a certain contracted or expanded state.

The contracted position and the expanded position together define the working range of the bell nipple. The slip joint permits relative movement of the upper tubular member and the lower tubular member within this working range. At any contracted or expanded position across this working range, the bottom surface of each piston is not above the radial plane at the contracted position, and the top surface of each piston is not below the radial plane at the expanded position. This is to say that the radial plane runs axially along and cuts through the one or more pistons throughout the working range of the bell nipple and the pistons remain partly submerged and partly emerged during this working range. This ensures that the pistons can continuously and consistently respond to volume change of the riser annulus due to heave across the working range of the bell nipple.

The bottom surface of each piston may be at the same radial level as or below the radial plane at the contracted position, and the top surface of each piston may be at the same radial level as or above the radial plane at the expanded position. This means the axial length of the pistons may be equal to or longer than the working range as defined between the radial plane at the contracted position and the radial plane at the expanded position.

When the bottom surface of each piston is at the same radial level as the radial plane at the contracted position, and the top surface of each piston is also at the same radial level as the radial plane at the expanded position, the axial length of the one or more pistons is equal to the working range as defined between the radial plane at the contracted position and the radial plane at the expanded position. In such embodiments, the one or more pistons don't exit beyond the radial limits as defined by the working range.

When the bottom surface of each piston is below the radial plane at the contracted position, and the top surface of each piston is above the radial plane at the expanded position, the axial length of the one or more pistons is longer than the working range as defined between the radial plane at the contracted position and the radial plane at the expanded position. In such embodiments, the one or more pistons extend beyond the radial planes as defined by the working range.

It is of course possible for the bottom surface of each piston to be at the same radial level as the radial plane at the contracted position, while the top surface of each piston is above the radial plane at the expanded position. Alternatively, it is also possible for the bottom surface of each piston to be below the radial plane at the contracted position, while the top surface of each piston is at the same radial level as the radial plane at the expanded position. If the bell nipple comprises a plurality of pistons, it is also possible for different pistons to have the same or different axial length and/or to be located at different axial locations with respect to the lower tubular member.

The slip joint may limit the extent of possible contraction and expansion, thus permitting relative movements of the two tubular members within a limit range between a most contracted position and a most expanded position.

The slip joint may permit contraction and expansion of the bell nipple between this limit range, and the radial plane at the most contracted position may be below the radial plane at the contracted position, and the radial plane at the most expanded position may be above the radial plane at the expanded position. In other words, the limit range may encompass the working range and may be larger than the working range, so as to provide for heave beyond normal working range in extreme and/or unexpected conditions.

Alternatively, the radial plane at the most contracted position may coincide with the radial plane at the contracted position, and the radial plane at the most expanded position may coincide with the radial plane at the expanded position. In other words, the limit range may coincide with and be equal to the working range.

It is of course also possible for the radial plane at the most contracted position to coincide with the radial plane at the contracted position, while the radial plane at the most expanded position is above the radial plane at the expanded position. Alternatively, it is also possible for the radial plane at the most contracted position to be below with the radial plane at the contracted position, while the radial plane at the most expanded position coincides with the radial plane at the expanded position.

The one or more pistons work across the working range of the bell nipple.

Optionally, the one or more pistons may work across the whole limit range. To work across the limit range, the bottom surface of each piston is optionally not above the radial plane at the most contracted position, and the top surface of each piston is optionally not below the radial plane at the most expanded position. This means that the radial plane runs axially along and cut through the one or more pistons throughout the limit range allowed the bell nipple. In these cases, the axial length of the pistons may be equal to, or longer than, that defined by the radial plane at the most contracted position and the radial plane at the most expanded position.

Alternatively, the top surface of the pistons may lie in between the radial plane at the most expanded position and the radial plane at the expanded position. Similarly, the bottom surface of the pistons may lie in between the radial plane at the most contracted position and the radial plane at the contracted position.

It may be beneficial for the one or more pistons to encompass and be longer than the working range, for the bottom surface of each piston to be substantially below the radial plane at the most contracted position, and the top surface of each piston to be substantially above the radial plane at the most expanded position. This feature would help make sure that the one or more pistons stay partly submerged and partly emerged in the mud across the whole working range even in turbulent conditions.

When there is turbulence in the riser annulus, the surface of the drilling mud may be unsteady as the mud heaves. In these cases, the pistons are disclosure provided with some extra length beyond the working range above the radial plane at the expanded position and/or below the radial plane at the contracted position so that they are more likely to stay partly submerged and partly emerged even when the mud level heaves.

Furthermore, if the bell nipple does not remain perfectly vertical all the time in operation, the one or more pistons may be longer than the working range. This is because when the bell nipple tilts, the discharge line or the mud level in the riser annulus before the drilling mud flows out of the side outlet remains substantially horizontal and therefore no longer coincides with the relevant radial plane which is perpendicular to the axis of the bell nipple, even though both planes pass the same lowest point of the side outlet. In these tilted cases, the total axial length of the one or more pistons in between the discharge line at the contracted position and the discharge line at the expanded position is greater than the total axial length of the one or more pistons in between the radial plane at the same contracted position and the radial plane at same the expanded position.

For the above reasons, in some embodiments one or more pistons may be used with an axial length that equals the working range defined by the radial plane at the contracted position and the radial plane at the expanded position, plus a further length equal to 20% of the working range above the radial plane at the expanded position and a further length equal to 20% of the working range below the radial plane at the contracted position.

The difference in the total axial length of the bell nipple between the contracted position and the expanded position may be at least 5 meters in order to allow for vertical movements of at least 5 meters due to heave. This means the axial length of each of the one or more pistons may be at least 5 meters. Preferably, the axial length of each of the one or more pistons may be at least 5 meters plus 20% above the radial plane at the expanded position and 20% below the radial plane at the contracted position, which is a total of at least 7 meters.

In these cases, the difference in the total axial length of the bell nipple between the most contracted position and the most expanded position may also be at least 5 meters, or alternatively substantially longer, e.g. approximately 10 meters, to allow for unexpected vertical displacement due to heave in extreme conditions and prevent potential damage to the bell nipple if it's forced to heave beyond normal conditions.

For use in more extreme conditions, the difference in the total axial length of the bell nipple between the contracted position and the expanded position may be e.g. at least 6, 8 or 10 meters. This means the axial length of each of the one or more pistons may be at least 6, 8 or 10 meters, or preferably at least 8.4, 11.2, or 14 meters respectively. Again, the difference in the total axial length of the bell nipple between the most contracted position and the most expanded position may be substantially bigger than the difference between the contracted position and the expanded position which define the working range.

In some embodiments, the total cross sectional area of the one or more pistons may be uniform between the radial plane at the contracted position and the radial plane at the expanded position.

In some embodiments, the cross sectional area of the slip joint is uniform between the radial plane at the contracted position and the radial plane at the expanded position, and the cross sectional area of the drillpipe is also uniform in between this range, so in these embodiments the total cross sectional area of the one or more pistons is also uniform within this range. Optionally, the slip joint permits a limit range within which the two tubular members can contract and expand. In such cases, the cross sectional area of the slip joint, the drillpipe and the one or more pistons may all remain constant between the radial plane at the most contracted position and the radial plane at the most expanded position.

Optionally, the shape of the one or more pistons across the working range between a contracted position and an expanded position may also remain constant. Optionally, the total cross sectional area of the one or more pistons is uniform between the top surface and the bottom surface of the one or more pistons so as to provide a simple device that is easy to design and manufacture.

However, the shape of the cross sectional area of the one or more pistons staying the same across the working range is not an essential feature and the shape does not need to remain the same throughout this working range as long as the cross sectional area remains the same within this range. In addition, the shape and the cross sectional area of the pistons at their far ends above and below the working range are both not important, and thus they are not required to be the same as the shape and cross sectional area within the working range. Optionally, the shape and/or cross sectional area of the one or more pistons across their entire axial length, i.e. within and beyond the working range, may remain constant and uniform to provide simplicity, but this is not essential.

The one or more pistons are fixed so that they are each substantially not axially movable relative to the lower tubular member. The one or more pistons may be fixed to the lower tubular member so that they don't move relative to the lower tubular member. Alternatively, the one or more pistons may be fixed to another component which doesn't move axially relative to the lower tubular member, so that pistons don't move axially relative to the lower tubular member. For example, the one or more pistons may be fixed to a riser section below lower tubular member which remains stationary with respect to axial movements of the lower tubular member.

The one or more pistons may each be fixed to the lower tubular member or another component which doesn't move axially relative to the lower tubular member via a rigid rod member, so that the one or more pistons don't move with respect to axial movements of the lower tubular member. The rod member may comprise a radial section mounted to the lower tubular member, and an axial section extending into the upper tubular member which is connected to the piston.

The one or more pistons may each be fixed to the lower tubular member or another component which doesn't move axially relative to the lower tubular member using a reversible fastener and/or a lock, so that the pistons can be changed or replaced for repair or if pistons of a different total cross sectional area is needed. The fastener may be mechanical and/or electrical.

The one or more pistons may each be fixed to the lower tubular member or another component which doesn't move relative to the lower tubular member using a latch. A latch is a type of mechanical fastener that is used to join two objects or surfaces together while allowing for the regular or eventual separation of the objects or surfaces. A latch typically engages another piece of hardware on the other mounting surface so it can engage the pistons onto the lower tubular member reversibly. The one or more pistons may each be fixed to the lower tubular member or another component which doesn't move relative to the lower tubular member using any suitable types of latch, for example a deadbolt latch, a spring latch, a cam lock, a Norfolk latch, a Suffolk latch, a crossbar, or a cabin hook.

Different pistons of the bell nipple may be fixed using the same or different mechanisms e.g. using the same or different types of latch. It is also possible that some pistons may be fixed permanently, while others are fixed reversibly.

The one or more pistons may be made of any suitable material such as plastic or steel or a combination thereof. Different pistons of the bell nipple may be made of the same or different materials.

In a second aspect, embodiments of the present disclosure provide a marine riser comprising a bell nipple as discussed above.

In a third aspect, embodiments of the present disclosure discloses a floating rig comprising a bell nipple as discussed above. The floating rig may be a drill ship, a semi-submersible platform, a floating drilling platform or a production platform.

In a fourth aspect, embodiments of the present disclosure discloses a method for setting up a bell nipple as discussed above for use in an offshore wellbore operation, the method comprising: running a first drillpipe through the bell nipple; and fixing a first set of one or more pistons so that they are each substantially not axially movable relative to the lower tubular member, wherein the total cross sectional area of the first set of one or more pistons at any radial plane in between the radial plane at the contracted position and the radial plane at the expanded position, is substantially the same as the cross sectional area of the slip joint less the cross sectional area of the first drillpipe at the same radial plane.

By incorporating one or more pistons at the level of the radial plane which is defined by the lowest point of the side outlet, passive heave compensation is achieved such that the flow rate of drilling fluid measured along the flowline is free from perturbation due to heave during offshore operations. This is because each piston is fixed so that it is substantially not axially movable relative to the lower tubular member, and the total cross sectional area of the one or more pistons is substantially the same as the cross sectional area of the slip joint less the cross sectional area of the drillpipe, so that the total volume of the riser annulus available for holding drilling fluid in the system remains constant despite irregular heave motion.

In a fifth aspect, embodiments of the present disclosure discloses a method for setting up a bell nipple as discussed above for use in an offshore wellbore operation, the method comprising: running a second drillpipe of through the bell nipple, wherein the cross sectional area of the second drillpipe is smaller than that of the first drillpipe; removing the first set of one or more pistons from the bell nipple; and fixing a second set of one or more pistons so that they are each substantially not axially movable relative to the lower tubular member, wherein the total cross sectional area of the second set of one or more pistons at any radial plane in between the radial plane at the contracted position and the radial plane at the expanded position, is substantially the same as the cross sectional area of the slip joint less the cross sectional area of the second drillpipe at the same radial plane.

By using a reversibly mounted piston set, the piston set may be easily replaced by a new piston set with a different total cross sectional area. This is beneficial when sequentially smaller drillpipes are used during drilling, to ensure that the total cross sectional area of the one or more pistons remains equal to the cross sectional area of the slip joint less the cross sectional area of the drillpipe.

In a sixth aspect, embodiments of the present disclosure discloses a method for using the bell nipple as discussed above with a drillpipe in an offshore wellbore operation, the method comprising: pumping drilling fluid down the drillpipe; and receiving the drilling fluid through the side outlet. The method may further comprise: measuring the flow rate of the drilling fluid.

To counter the perturbation effects when a floating rig heaves, a bias piston is connected to the riser below the slip joint but level with the mud discharge line. As the slip joint moves, the volume displaced by the piston is equivalent to the volume displaced by the slip joint so there is no perturbation in flow rate of the drilling fluid out of the system.

The steps in the above methods may be performed in any order. For example, the one or more pistons may be fitted first before a drillpipe is run through the bell nipple.

BRIEF DESCRIPTION OF THE DRAWINGS

The disclosure will now be described, by way of example only, with reference to the accompanying drawings in which:

Referring now to the drawings, FIG. 1 illustrates an offshore wellsite system in which embodiments of the present disclosure can be employed. A floating rig 10 such as a drill ship or a semi-submersible platform floats on the surface of the water 5 and is susceptible to heave.

Figure 1:
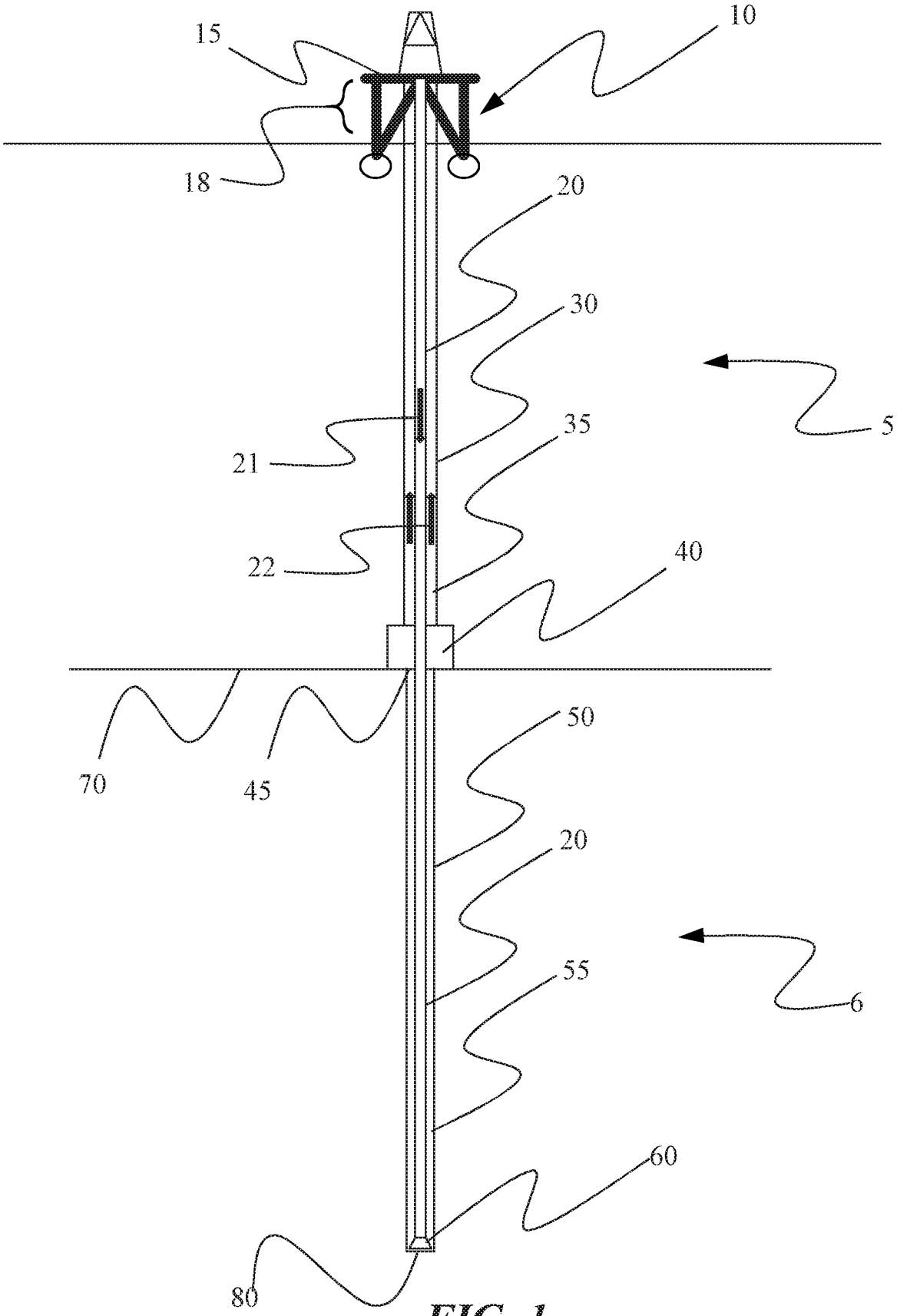
FIG. 1 shows an offshore wellsite system in which embodiments of the present disclosure can be employed.

Offshore drilling may be carried out from such a floating rig 10. Similar to onshore drilling, a drill bit 60 is suspended in the wellbore on a drillstring (not shown) and rotated against the bottom of the wellbore 80 in order to remove subsea formations 6 and extend the wellbore. When drilling a subsea wellbore from a floating rig 10, a marine riser 30 is provided between the drilling platform 15 and the seafloor 70. The top of the riser is attached to the rig 10, while its bottom is secured to the wellhead 45 at the seafloor 70. A blowout preventer (BOP) 40 is placed at the seafloor between the wellhead and the riser to provide protection against overpressured formations and sudden release of gas.

In operation, drilling fluid or drilling mud is pumped from the floating rig 10 down through the drillpipe 20 using a mud pump (not shown). Drilling fluid is typically a mixture of water, clay, weighting material and chemicals, used to lift rock cuttings from the drill bit to the surface under pressure. The drilling fluid travels down the drillpipe as indicated by arrow 21. It first travels through the section of the drillpipe 20 between the rig 10 and the wellhead 45 and then travels down the section of the drillpipe 20 between the wellhead 45 and the bottom of the borehole 80. At the bottom of the borehole 80, drilling fluid runs out of the drillpipe 20 and enters the wellbore 80 via the drill bit nozzles. It then returns to the surface carrying with it formation cuttings produced by the drill bit 60 during drilling. The drilling fluid and the cuttings travel upwards from the bottom of the borehole 80 to the wellhead 45 through the annulus 55 between the borehole 50 and the drillpipe 20, and then continue upwards from the wellhead 45 to the surface through the riser annulus 35 between the riser 30 and the drillpipe 20.

The top section of a riser 30 is provided by a bell nipple 18. A bell nipple 18 is an enlarged pipe at the top of riser 30 that serves as a funnel to guide drilling tools into the top of a well 45. For example, a riser pipe diameter of up to 21 inches may be large enough to allow the drillpipe, logging tools and multiple casing strings to pass through.

Figure 2:
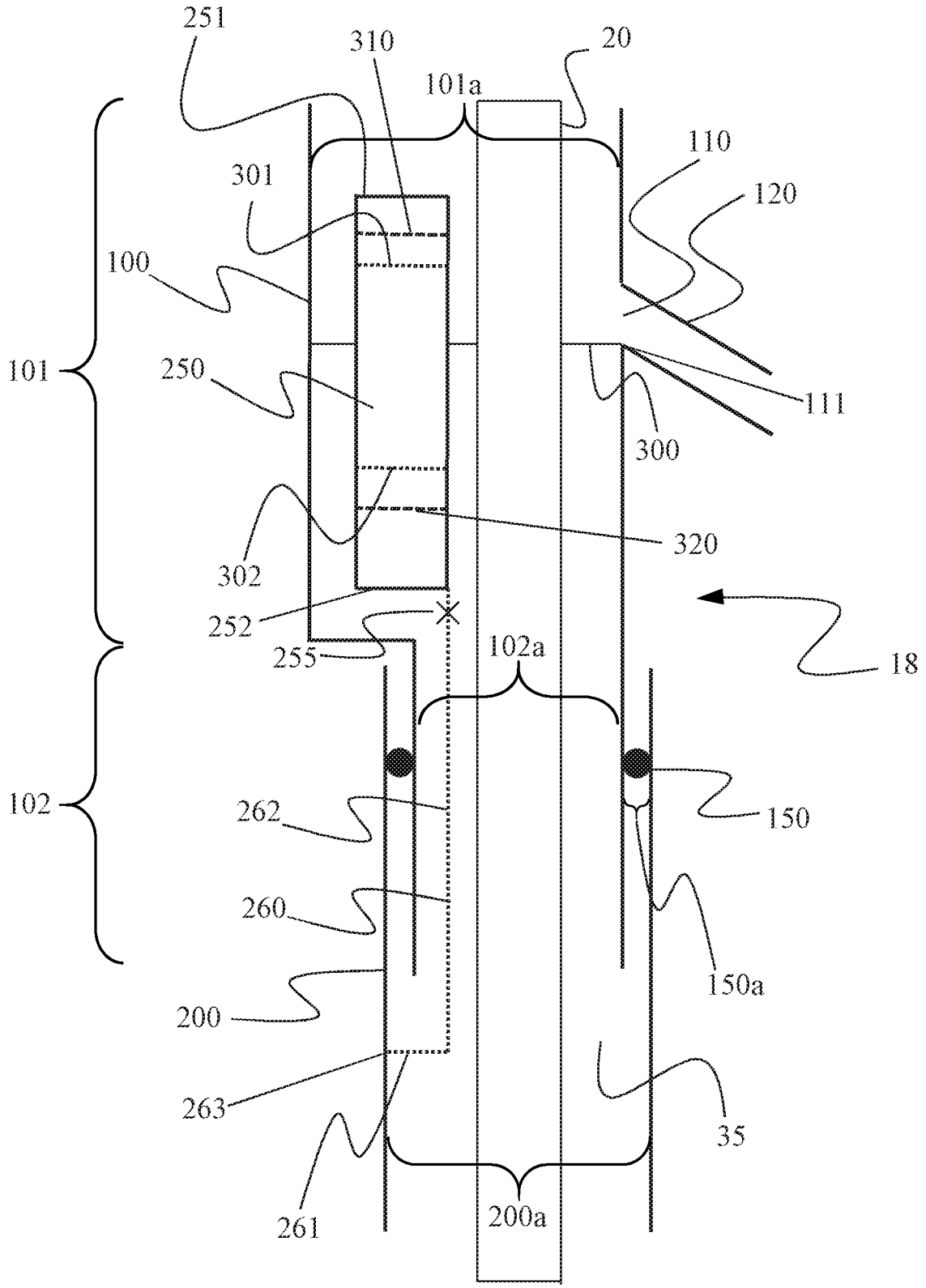
FIG. 2 is a schematic partial cross sectional view of a bell nipple comprising a piston in accordance with embodiments of the present disclosure.

FIG. 2 illustrates a bell nipple 18 in accordance with embodiments of the present disclosure, comprising an upper tubular member 100 and a lower tubular member 200 connected telescopically via a slip joint 150.

The slip joint 150 permits relative movements of the upper tubular member 100 and the lower tubular member 200. As the floating rig 10 heaves during offshore operations, the slip joint 150 telescopes in or out so that the riser below the slip joint 150 is relatively unaffected by the heave motion.

To prevent leakage of the drilling fluid, the slip joint 150 connection is sealed. An external casing (not shown) may also be provided over the slip joint 150 to provide additional support and seal.

In this embodiment, the upper tubular member 100 has a diameter 102*a* around the slip joint 150, which is smaller than that 200*a* of the lower tubular member 200 and thus it can telescope into and out of the lower tubular member 200 in between a contracted position and an expanded position, or between a most contracted position and a most expanded position if such limits are provided by the slip joint 150. Thus, in this embodiment the upper tubular member 100 acts as the inner tubular member and telescopes into and out of the lower tubular member, which acts as the outer tubular member. Alternatively, the lower tubular member 200 may act as the inner tubular member and the upper tubular member 100 as the outer tubular member of the telescopic arrangement.

The upper tubular member 100 is fitted with a side outlet 110 to permit drilling fluid in the riser annulus 35 to flow back to the surface mud treating equipment (now shown) through another inclined pipe called a flowline 120.

Once the drilling fluid is treated by the mud-cleaning equipment, it is returned to the mud tanks and pumped through the system again. The mud level at the mud tank is monitored so that e.g. loss of drilling mud downhole can be detected and dealt with in a timely manner.

The flow rate of the drilling fluid may be measured at the side outlet 110 or in the flowline 120, e.g. by a coriolis flow meter, in order to calculate the flow rate of the drilling fluid in the riser annulus 35 below the slip joint. The flow rate of drilling fluid in the riser annulus 35 is important, because many important information can be derived from this measurement, such as determinations with respect to wellbore pressure, transport velocity, lag time and the like.

Drilling mud flow measurement can be a very challenging measurement. Wide variations in the type of mud, the solids content, the type of solids and other factors requires flow meters that have the ability to measure drilling fluids with wide ranges of fluid viscosity, density, conductivity and resistivity.

As discussed above, heave motion in the upper tubular member 100 leads to a perturbation of flow rate of the drilling fluid out of the side outlet 110 into the flowline 120. This represents an additional challenge in drilling mud flow measurement.

If the upper and lower tubular members 100, 200 don't move in relation to each other e.g. in the absence of heave, this volume of the riser annulus 35 would remain constant, and the flow rate of drilling fluid out of the side outlet 110 would be the same as the flow rate of the drilling fluid in the wellbore below the slip joint 150.

By contrast, as the upper and lower tubular members 100, 200 telescope outwards towards the expanded position, the total volume of the riser annular space 35 increases. The drilling fluid needs to fill in the increased volume first, before it can flow out of the side outlet 110 and this delays the outflow and slows down the flow rate. Thus, when the total volume of the riser annulus 35 increases due to heave, the flow rate of drilling fluid out of the outlet 110 would be slower compared to the flow rate in the wellbore below the slip joint 150.

Similarly, when the upper and lower tubular members 100, 200 telescope inwards towards the contracted position, the total volume of the riser annulus decreases and this in turn squeezes the drilling fluid out of the side outlet 110 and increases the flow rate out of the side outlet 110.

In these cases, the flow rate measured in the flowline 120 is no longer an accurate measurement of the flow rate in the wellbore below the slip joint level 150, but instead includes irregular perturbation effects due to heave.

The present disclosure provides a simple solution to this problem by disclosing a bell nipple 18 which comprises a piston 250 for heave compensation of the flow of the drilling fluid out of the side outlet 110. Furthermore, the present disclosure provides a passive heave compensation system which requires no motor or other external input to control the action of the piston 250.

The piston 250 moves with the lower tubular member 200 and remains substantially stationary with respect to vertical movements of the lower tubular member 200. The piston 250 is therefore movable relative to the upper tubular member 100, as the lower tubular member 200 moves relative to the upper tubular member 100. Because the piston 250 remains substantially stationary with respect to vertical movements of the lower tubular member 200, it moves by the same axial distance as the lower tubular member 200 in relation to the upper tubular member 100. Thus, when the two tubular members 100, 200 contract, the axial length decrease of the bell nipple is equal to the increase of the axial length of the piston 250 above the radial plane 300 defined by the lowest point 111 of the side outlet 110. Similarly, when the two tubular members 100, 200 expand, the axial length increase of the bell nipple is equal to the decrease of the axial length of the piston 250 above the radial plane 300.

As the upper and lower tubular members 100, 200 contract, the total axial length of the bell nipple decreases, and thus the total volume available for holding the mud in the system decreases. The total volume decrease is the total volume lost due to the contraction, which is the volume loss in the riser annulus 35 at the slip joint 150 as the upper tubular member 100 telescopes into the lower tubular member 200. This volume decrease is equal to the total axial length decrease of the bell nipple, multiplied by the cross sectional area of the annulus 35 at the slip joint 150. The cross sectional area of the riser annulus 35 at the slip joint 150 may be calculated by cross sectional area of the slip joint 150 less the cross sectional area of the drillpipe 20.

This volume decrease is compensated by the increase of the volume for holding mud due to the piston 250 moving out of the drilling fluid as the two tubular members 100, 200 contract. The piston 250 has the same cross sectional area as that of the slip joint 150 less the drillpipe 20. Furthermore, the piston 250 also moves upwards out of the mud by the same axial distance as the total axial length decrease of the bell nipple as the two tubular members 100, 200 contract. Therefore the volume increase due to the piston moving out of the drilling fluid is the same as the volume decrease due to the contraction and the decrease in the axial length of the bell nipple. Thus the total volume available in the system to hold mud in the riser annulus 35 remain constant as the two tubular members 100, 200 contract and the total axial length of the bell nipple 18 decreases.

Similarly, when the upper tubular member 100 and the lower tubular member 200 expand, the volume increase of the riser annulus 35 for holding mud in the system is compensated by the volume decrease due to the piston 250 moving into the drilling fluid taking up annulus space previously reserved for drilling fluid. The piston 250 is required to have the same cross sectional area as the slip joint 150 less the drillpipe 20 in order to displace an equal amount of mud to that volume which is increased as the upper tubular member 100 moves upwards. Thus, the total volume available in the system to hold mud in the riser annulus 35 remain constant as the two tubular members 100, 200 expand and the total axial length of the bell nipple 18 increases.

Accordingly, the piston 250 moves in a counteracting motion into and out of the drilling fluid with the vertical movement of the floating rig 10, and the piston 250 constantly displaces a swept volume equal to the swept volume change of the slip joint movement, but in opposite direction to ensure the total volume available in the system to hold mud in the riser annulus 35 consistently remain constant as the two tubular members 100, 200 contract and expand in an irregular and random fashion with the waves in the water 5. This eliminates first order perturbation effects in the flow rate of the drilling fluid out of the riser annulus 35 as the floating rig 10 heaves.

For more accurate calculation of the cross sectional area of the riser annulus 35 at the slip joint 150, the exact configuration of the slip joint 150 needs to be considered.

If the slip joint 150 is configured to remain stationary with respect to the outer tubular member as the bell nipple 18 telescopes, the external diameter of the inner tubular member around the slip joint 150 may be used to calculate the cross sectional area of the slip joint 150. Furthermore, the external diameter of the drillpipe 20 around the slip joint 150 may be used to calculate the cross sectional area of the drillpipe 20. Using these diameters gives a more accurate calculation of the cross sectional area of the riser annulus 35 at the slip joint 150, because the difference between these two cross sectional areas represents the exact cross sectional area loss (or gain) as the inner tubular member telescopes into (or out of) the outer tubular member and thus may be used for calculating the exact volume decrease (or increase) that is available for holding mud in the system as the two tubular members 100, 200 contract (or expand).

Similarly, if the slip joint 150 is configured to remain stationary with respect to the inner tubular member as it telescopes, the internal diameter of outer tubular member around the slip joint 150 may be used to calculate the cross sectional area of the slip joint 150, and again the external diameter of the drillpipe 20 may be used to calculate the cross sectional area of the drillpipe 20 for a more accurate calculation of the cross sectional area of the riser annulus 35 at the slip joint 150.

If the slip joint 150 is configured to stay loose in between the outer tubular member and the inner tubular member and does not remain stationary with respect to either tubular member as the slip joint 150 telescopes, it is more difficult to obtain a more accurate calculation of the exact cross sectional area of the riser annulus 35 at the slip joint 150.

In any case, the cross sectional area of the slip joint 150 may be used as a good estimate in calculating the cross sectional area of the riser annulus 35 at the slip joint 150. The cross sectional area of the slip joint 150 may be calculated using the external diameter of the slip joint 150, the internal diameter of the slip joint 150, or an average of the two.

In this embodiment, the piston 250 is made of steel, and is fixed to the lower tubular member 200 through a rigid rod 260 also made of steel. The rod 260 comprises a short radial section 261 for connection to the inner surface of the lower tubular member 200, a longer axial section 262 into the upper tubular member 100 for connection with the piston 250. The rod 260 is above a certain thickness and/or rigidity so as to ensure that the piston 250 substantially does not move axially relative to the lower tubular member 200, and the steel rod 260 allows no deformation along its length.

The piston 250 may be allowed to move radially with respect to the lower tubular member 200 as long as there is no relative axial movement. However, this radial movement may not always be practical because the annular space 35, in which the piston 250 is located, may limit the extent of such radial movements, because there may always space between the piston 250 and the inner surface of upper tubular member 100 and between the piston 250 and the drillpipe 20, so that there is no friction between these components as the slip joint telescopes.

If the piston 250 tilts in relation to the lower tubular member 200, then there is by definition axial movement as well as radial movement relative to the lower tubular member 200. Therefore, tilting of the piston 250 with respect to the lower tubular member may be substantially prevented to ensure the piston 250 is so fixed that it substantially does not move axially relative to the lower tubular member 200. Tilting of the piston 250 may be substantially prevented by e.g. increasing the thickness and/or rigidity of the rod member 260, or increasing the number of rod members used to fix the piston 250 to the lower tubular member 200.

The radial plane 300 defined by the lowest point 111 of the side outlet 110 lies radially across the piston 250. Part of the piston 250 is below the radial plane 300 and part above the radial plane 300 as the bell nipple 18 contracts and expands between the working range defined by the radial plane 301 of the expanded position and radial plane 302 at the contracted position. As the bell nipple 18 contracts and expands between the working range, the radial plane 300 runs along the piston 250 and remains at a position within the axial length of the piston 250. Each total axial length of the bell nipple 18 corresponds to a respective radial plane 300 with respect to the lower tubular member 200, which marks a respective axial location along the piston 250. Thus, each radial location along the piston 250 can be defined by a respective radial plane 300 at a particular contracted or expanded position of the bell nipple 18.

As the bell nipple 18 expands, the radial plane 300 moves upwards along the piston 250 until it reaches the radial plane 301 at the expanded position of the working range. If the bell nipple is permitted to expand further, it may reach the radial plane 310 at the most expanded position of the limit range as allowed by the slip joint 150.

Similarly, as the bell nipple 18 contracts, the radial plane 300 moves downwards along the piston 250 until it reaches the radial plane 302 at the contracted position of the working range. If the bell nipple is permitted to contract further, it may reach the radial plane 320 at the most contracted position of the limit range as allowed by the slip joint 150.

The piston 250 may be as long as the distance between radial plane 301 at the expanded position and the radial plane 302 at the contracted position. It may be placed such that the top surface 251 of the piston 250 coincides with the radial plane 301 at the expanded position and the bottom surface 252 of the piston 250 coincides with the radial plane 302 at the contracted position.

Alternatively, the piston 250 may be longer than the distance between the radial planes 301, 302 of the working range to ensure that the piston 250 is always partly submerged and partly emerged in the mud even when there is turbulence in the flow of the mud in the riser annulus 35. For example, it is common for the actual mud level to be above the radial plane 300 as defined by the lowest point 111 of the side outlet 110, when the mud flows fast upwards in the riser annulus 35 so that it accumulates above the radial plane 300 before entering the side outlet 110. Furthermore, the mud may heave due to turbulent internal mud flow, or external heave in the water 5. For this reason, an extra length equal to approximately 20%, 30%, or 40% of the distance between the radial planes 301, 302 of the working range may be provided on both axial ends of the piston 250.

The piston 250 may be longer than the distance between the radial plane 301 at the expanded position and the radial plane 302 at the contracted position, and shorter than the distance between the radial plane 310 at the most expanded position and the radial plane 320 at the most contracted position. Optionally, the piston 250 may be as long as the distance between the radial plane 310 at the most expanded position and the radial plane 320 at the most contracted position. Optionally, the piston 250 may be longer than the distance between the radial planes 310, 320 of the limit range. For example, an extra length equal to approximately 20%, 30%, or 40% of the distance between the radial plane 310 and the radial plane 320 may be provided on both axial ends of the piston 250. Different pistons of the bell nipple 18 may have the same or different axial length.

The difference in the total axial length of the bell nipple between the contracted position and the expanded position may be at least 5 meters. Therefore, the axial length of each piston is at least 5 meters and is positioned between the radial plane 301 at the expanded position and the radial plane 302 at the contracted position. Alternatively, the axial length of each piston is at least 5 meters plus approximately 20% above radial plane 301 at the expanded position and approximately 20% below the radial plane 302 at the contracted position. Accordingly, the axial length of each piston may be at least 7 meters. Optionally, the difference in the total axial length of the bell nipple between the contracted position 302 and the expanded position 301 may also be at least 6, 8, 10 meters, or even more than 10 meters for use in more turbulent offshore conditions.

In this embodiment, the upper tubular member 100 comprises two sections, a lower section 102 and an upper section 101.

The lower section 102 of the upper tubular member 100 has a diameter **102*a* that's a bit smaller than that 200*a* of the lower tubular member 200, so that the lower section 102 of the upper tubular member 100 can telescope into and out of the lower tubular member 200 via a slip joint 150. In order to accommodate the slip joint 150 in between the inner tubular member and the outer tubular member of the telescope and help provide a sealed connection between the two tubular members 200 at the slip joint 150, the difference between the external diameter of the lower section 102 of the upper tubular member 100 and the internal diameter of the lower tubular member 200 may be approximately twice as the external diameter 150***a* of the slip joint 150.

Alternatively, the lower section 102 may be the outer tubular member and the lower tubular member 200 the inner tubular member. In these cases, the difference between the internal diameter of the lower section 102 of the upper tubular member 100 and the external diameter of the lower tubular member 200 is approximately twice as the external diameter 150*a* of the slip joint 150.

The upper section 101 of the upper tubular member 100 has a diameter 101*a* that is substantially larger than that of the lower section 102. The piston is located in the upper section 101. As the cross sectional area of the piston 250 is the same as the cross sectional area of the annular space 35 around the slip joint 150, the piston is optionally located in an annular space which has a larger cross sectional area than the annular space 35 around the slip joint 150. Otherwise, the piston 250 would fill the whole annular space 35 and it would be hard for the piston 250 to move relative to the drillpipe 20 and the upper tubular member 100 due to friction. Therefore, a larger upper section 101 would allow space between the piston 250 and the drillpipe 20 and between the piston 250 and the inner surface of the upper tubular member 100, which permits the piston 250 to move with the lower tubular member 200 freely in the riser annulus 35 of the upper tubular member 100 without friction with adjacent pipes 20, 101.

This embodiment comprises a single piston. However, the same effect can be achieved by using a plurality of pistons. In some embodiments, the plurality of pistons may spread evenly across the riser annulus 35. When a single piston or unevenly spread plurality of pistons are used, the upper section 101 and the lower section 102 of the upper tubular member 100 may be off centred and not concentric.

Optionally, two pistons may be provided each in the shape of a half annulus which fits within the riser annulus 35 in the upper section 101 of the upper tubular member 100. This arrangement helps stabilize the pistons and fix them in position with respect to the lower tubular member 200 e.g. by reducing tilting of the pistons in relation to the lower tubular member 200. In these embodiments, a concentric upper section 101 may be provided that shares the same central axis as the lower section 102. Optionally, the two pistons are smaller than the riser annulus 35 of the upper section 101 so that there is substantially no friction when the pistons move up and down with respect to the upper section 101. The two pistons may each be fixed relative to the lower tubular member by a respective rigid rod member at two opposing ends across the diameter of the riser annulus 35.

Alternatively, three, four, or more pistons may be provided and they may together form a ring shaped structure which fits within the riser annulus 35 of the upper section 101.

In this embodiment, the piston 250 is fixed to the lower tubular member 200 at a single mounting point 263 using a single rod on the lower tubular member 200. Alternatively, each piston may be fixed using a plurality of mounting means at a plurality of mounting points on the lower tubular member 200 or on another component, which remains stationary with respect to axial movements of the lower tubular member 200. For example, each piston may be fixed relative to the lower tubular member 200 by two or more rigid rod members.

Therefore, there may be a plurality of rod members running parallel to each other in the riser annulus 35. The rods may be interconnected to each other in order to provide support, improve strength and reduce movement in the system. For example, each piston may be fixed using a net structure in the form of a metal sheet with a plurality of holes, which runs partly or fully along the riser annulus 35. One or more such net structures may be provided as mounting means for the one or more pistons.

Different pistons of the bell nipple 18 may have the same or different shape along the axial length. Furthermore, the top surface 251 and the bottom surface 252 of each piston may be flat and perpendicular to the axis of the piston, but this is not an essential feature.

To set up the bell nipple 18, a drillpipe 20 is run through the bell nipple 18, and one or more pistons are fitted so that they remain substantially stationary with respect to axial movements of the lower tubular member 200, wherein the total cross sectional area of the one or more pistons at any radial plane in between the radial plane 302 at the contracted position and the radial plane 301 at the expanded position, is substantially the same as the cross sectional area of the slip joint 150 less the cross sectional area of the drillpipe 20 at the same radial plane.

In an offshore wellbore operation, drilling fluid is pumped down through the drillpipe 20 at the rig 10. The drill fluid flows down the drillpipe 20 and then returns with cuttings up the annulus 55 between the wellbore and the drillpipe and then up the riser annulus 35 between the riser 50 and the drillpipe 20. The drilling fluid flows out at the top of the riser annulus 35 through the side outlet 110 into the flowline 120. Due to the presence of the one or more pistons in the system for passive heave compensation, the flow rate of the drilling fluid measured at the side outlet 110 or in the flowline 120 is free from first order perturbation effects due to heave, and thus more accurately represents the flow rate of the drill fluid in the riser annulus 35 below the slip joint 150.

During drilling, sequentially smaller drillpipes may be used. The cross sectional area of slip joint 150 less that of the drillpipe 20 increases as the size of the drillpipe used decreases. Thus, one or more pistons with correspondingly larger total cross sectional area may be needed as the diameter of the drillpipe used decreases.

When a smaller drillpipe 20 is used, the existing piston set is removed and a new piston set with a larger total cross sectional area is fitted, wherein the total cross sectional area of the new set of one or more pistons at any radial plane in between the radial plane 302 at the contracted position and the radial plane 301 at the expanded position, is substantially the same as the cross sectional area of the slip joint 150 less the cross sectional area of the new drillpipe 20 at the same radial plane.

Alternatively, a bigger drillpipe may be needed. Then the existing piston set may be removed and a new piston set with a correspondingly smaller total cross sectional area may be fitted.

It is therefore beneficial for the one or more pistons to be reversibly fixed, so that the pistons can be easily replaced. In this embodiment, this is achieved by providing a latch 255 at the upper end of the rod member 260 to reversibly connect the piston 250 to the rod member 206. However, any suitable types of reversible fastener may be used.

Additionally, a lock may also be used to improve accuracy of operation and to reduce error and/or failure. A lock is a mechanical or electronic fastening device that is released by a physical object such as a key or fingerprint by supplying secret information such as a keycode or password, or by a combination thereof.

As used herein, "about", "approximately," and "substantially" will be understood by persons of ordinary skill in the art and will vary to some extent on the context in which they are used. If there are uses of the term which are not clear to persons of ordinary skill in the art given the context in which it is used, "about", "approximately," and "substantially" will mean plus or minus 10% of the particular term.

While the invention has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the invention.

The invention claimed is:

1. A bell nipple for use with a drillpipe in an offshore wellbore operation, the bell nipple comprising:

an upper tubular member and a lower tubular member, wherein the upper tubular member and the lower tubular member are connected telescopically via a slip joint and are axially movable relative to each other between a contracted position and an expanded position;

a side outlet in the upper tubular member for connection with a side pipe, wherein the lowest point of the side outlet defines a radial plane of the upper tubular member; and one or more pistons configured in use to remain in a fixed axial position relative to the lower tubular member, wherein each piston has a bottom surface and a top surface, and wherein the bottom surface of each piston is not above the radial plane at the contracted position, and the top surface of each piston is not below the radial plane at the expanded position, wherein the total cross sectional area of the one or more pistons at any radial plane in between the radial plane at the contracted position and the radial plane at the expanded position, is substantially the same as the cross sectional area of the slip joint less the cross sectional area of the drillpipe at the same radial plane.

2. The bell nipple of claim 1, wherein the slip joint permits contraction and expansion of the bell nipple between a most contracted position and a most expanded position, and wherein the radial plane at the most contracted position is below the radial plane at the contracted position, and the radial plane at the most expanded position is above the radial plane at the expanded position.

3. The bell nipple of claim 1, wherein the slip joint permits contraction and expansion of the bell nipple between a most contracted position and a most expanded position, and wherein the radial plane at the most contracted position coincides with the radial plane at the contracted position, and the radial plane at the most expanded position coincides with the radial plane at the expanded position.

4. The bell nipple of claim 2, wherein the bottom surface of each piston is not above the radial plane at the most contracted position, and the top surface of each piston is not below the radial plane at the most expanded position.

5. The bell nipple of claim 1, wherein the axial length of each of the one or more pistons is at least 5 meters.

6. The bell nipple of claim 1, wherein the total cross sectional area of the one or more pistons is uniform between the radial plane at the contracted position and the radial plane at the expanded position.

7. The bell nipple of claim 1, wherein the total cross sectional area of the one or more pistons is uniform between the top surface and the bottom surface of the one or more pistons.

8. The bell nipple of claim 1, wherein the one or more pistons are each fixed to the lower tubular member, or to another component that is not axially movable relative to the lower tubular member.

9. The bell nipple of claim 8, wherein the one or more pistons are each fixed via a rigid rod member.

10. The bell nipple of claim 8, wherein the one or more pistons are each fixed using a reversible fastener.

11. The bell nipple of claim 8, wherein the one or more pistons are each fixed using a latch.

12. The bell nipple of claim 1, wherein the one or more pistons are made of steel.

13. A marine riser comprising the bell nipple of claim 1.

14. A floating rig comprising the bell nipple of claim 1.

15. A method for setting up the bell nipple of claim 1 with drillpipe for use in an offshore wellbore operation, the method comprising:

running a first drillpipe through the bell nipple; and fixing a first set of one or more pistons so that they are each not axially movable relative to the lower tubular member, wherein the total cross sectional area of the first set of one or more pistons at any radial plane in between the radial plane at the contracted position and the radial plane at the expanded position, is substantially the same as the cross sectional area of the slip joint less the cross sectional area of the first drillpipe at the same radial plane.

16. The method of claim 15, further comprising:

running a second drillpipe of through the bell nipple, wherein the cross sectional area of the second drillpipe is smaller than that of the first drillpipe;

removing the first set of one or more pistons from the bell nipple; and fixing a second set of one or more pistons so that they are each not axially movable relative to the lower tubular member, wherein the total cross sectional area of the second set of one or more pistons at any radial plane in between the radial plane at the contracted position and the radial plane at the expanded position, is substantially the same as the cross sectional area of the slip joint less the cross sectional area of the second drillpipe at the same radial plane.

17. A method for using the bell nipple of claim 1 with drillpipe in an offshore wellbore operation, the method comprising:

pumping drilling fluid down the drillpipe; and receiving the drilling fluid through the side outlet.

18. The method of claim 17, further comprising:

measuring the flow rate of the drilling fluid.

19. The bell nipple of claim 3, wherein the bottom surface of each piston is not above the radial plane at the most contracted position, and the top surface of each piston is not below the radial plane at the most expanded position.

* * * * *